US011333995B2

(12) United States Patent
Jung

(10) Patent No.: US 11,333,995 B2
(45) Date of Patent: May 17, 2022

(54) SUPPLYING REFILL TONER TO MOUNTED TONER CARTRIDGE

(71) Applicant: HEWLETT-PACKARD DEVELOPMENT COMPANY, L.P., Spring, TX (US)

(72) Inventor: Jung Woon Jung, Pangyo (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/040,872

(22) PCT Filed: Jul. 31, 2018

(86) PCT No.: PCT/KR2018/008653
§ 371 (c)(1),
(2) Date: Sep. 23, 2020

(87) PCT Pub. No.: WO2019/208874
PCT Pub. Date: Oct. 31, 2019

(65) Prior Publication Data

US 2021/0026273 A1 Jan. 28, 2021

(30) Foreign Application Priority Data

Apr. 27, 2018 (KR) ..... 10-2018-0049428

(51) Int. Cl.
*G03G 15/08* (2006.01)

(52) U.S. Cl.
CPC ..... *G03G 15/0863* (2013.01); *G03G 15/0865* (2013.01); *G03G 15/0877* (2013.01); *G03G 2215/0697* (2013.01)

(58) Field of Classification Search
CPC ..... G03G 15/0865; G03G 15/0867; G03G 15/0877; G03G 2215/0697
See application file for complete search history.

(56) References Cited

U.S. PATENT DOCUMENTS 3,599,682 A * 8/1971 Altmann ..... G03G 15/0884 141/106
3,651,838 A * 3/1972 Albert ..... G03G 15/0855 141/284
4,237,943 A * 12/1980 Ermel ..... G03G 15/0875 141/284
4,307,763 A * 12/1981 Wang ..... G03G 15/104 138/89

(Continued)

FOREIGN PATENT DOCUMENTS

EP 1041455 A2 10/2000
EP 1335252 A2 8/2003

(Continued)

*Primary Examiner* — David J Bolduc
(74) *Attorney, Agent, or Firm* — Staas & Halsey LLP

(57) ABSTRACT

Provided is an image forming apparatus which includes an image forming job unit in which a toner cartridge is mounted, a toner refill unit, and a controller. The toner refill unit may be connected to refill toner supplies, and to supply refill toner to the mounted toner cartridge from the refill toner supplies. The controller may control the image forming apparatus, based on an operation of the toner refill unit.

14 Claims, 6 Drawing Sheets

(56) References Cited

U.S. PATENT DOCUMENTS 4,456,154 A * 6/1984 Herriman ..... G03G 15/0875 141/363
4,489,765 A * 12/1984 Yamada ..... G03G 15/0855 141/1
5,079,591 A * 1/1992 Tomita ..... G03G 15/0855 399/262
5,614,996 A * 3/1997 Tanda ..... G03G 21/12 141/363
5,802,431 A * 9/1998 Nagashima ..... G03G 15/0874 399/262
5,887,232 A * 3/1999 Phillips ..... G03G 15/0855 399/262
6,212,338 B1 * 4/2001 Hagihara ..... G03G 15/0863 399/12
6,249,654 B1 * 6/2001 Kurz ..... G03G 15/087 399/12
6,304,739 B1 * 10/2001 Katsuyama ..... G03G 15/0874 222/DIG. 1
6,393,241 B1 * 5/2002 Matsumoto ..... G03G 15/0822 399/258
6,571,076 B2 * 5/2003 Kasahara ..... G03G 15/0874 399/258
6,598,625 B2 * 7/2003 Allison ..... B41J 2/17509 141/18
6,676,252 B2 * 1/2004 Bilotta ..... B41J 2/17509 347/85
6,813,460 B2 * 11/2004 Sudo ..... G03G 15/0874 399/258
6,862,420 B1 * 3/2005 Less ..... G03G 15/0884 399/258
7,300,130 B2 * 11/2007 Bellinger ..... B41J 2/17513 347/17
7,959,270 B2 * 6/2011 Durham ..... G03G 15/0855 347/85
8,929,776 B2 * 1/2015 Yamabe ..... G03G 15/0879 399/258
9,360,799 B2 * 6/2016 Itabashi ..... G03G 15/0879
9,658,569 B2 5/2017 Kayahara
11,055,038 B2 * 7/2021 Lavigne ..... B41J 2/17546
2001/0041083 A1 * 11/2001 Terazawa ..... G03G 15/0865 399/258
2002/0009310 A1 * 1/2002 Kabumoto ..... G03G 15/0126 399/258
2002/0039502 A1 * 4/2002 Matsumoto ..... G03G 15/0877 399/258
2003/0118355 A1 * 6/2003 Guy ..... G03G 15/0863 399/12
2003/0170049 A1 * 9/2003 Itoh ..... G03G 15/0865 399/258
2004/0037591 A1 * 2/2004 Schlageter ..... G03G 15/0855 399/258
2004/0040614 A1 * 3/2004 Sesek ..... B41J 2/17506 141/2
2005/0013633 A1 * 1/2005 Harumoto ..... G03G 15/0855 399/258
2005/0041998 A1 * 2/2005 Fujii ..... G03G 15/086 399/258
2005/0157117 A1 * 7/2005 Silverbrook ..... B41J 2/17506 347/86
2006/0002743 A1 * 1/2006 Katsuyama ..... G03G 15/0877 399/258
2006/0109320 A1 * 5/2006 Cutler ..... B41J 2/17506 347/84
2006/0263116 A1 * 11/2006 Katsuyama ..... B65D 1/0292 399/258
2007/0116494 A1 * 5/2007 Uno ..... G03G 15/0865 399/258
2008/0025743 A1 * 1/2008 Hori ..... G03G 15/0877 399/61
2008/0285986 A1 11/2008 Wada
2009/0277911 A1 * 11/2009 Koide ..... B65D 77/062 220/495.08
2010/0092216 A1 * 4/2010 Spence ..... G03G 15/0822 399/258
2010/0172659 A1 7/2010 Jeon
2011/0097094 A1 * 4/2011 Hamano ..... G03G 15/0856 399/27
2011/0217067 A1 * 9/2011 Tokuno ..... G03G 15/0872 399/110
2012/0177406 A1 * 7/2012 Suzuki ..... G03G 15/0874 399/120
2012/0213538 A1 8/2012 Tomaru
2012/0269540 A1 * 10/2012 Kawai ..... G03G 21/181 399/109
2014/0227008 A1 * 8/2014 Janssen ..... G03G 15/0886 399/258
2015/0063865 A1 * 3/2015 Furuichi ..... G03G 15/0865 399/111
2017/0153575 A1 * 6/2017 Schulkes ..... G03G 15/0881
2020/0133180 A1 * 4/2020 Mitsuhashi ..... G03G 15/0894

FOREIGN PATENT DOCUMENTS

EP 1548519 A2 * 6/2005 ..... G03G 15/0867
JP 10020647 A * 1/1998
JP 2005338386 A 12/2005
JP 20100078669 4/2010
JP 20110022400 2/2011
JP 20170111281 6/2017
KR 200355637 7/2004
KR 20060016226 2/2006
KR 100738948 7/2007

* cited by examiner

[Fig. 1]
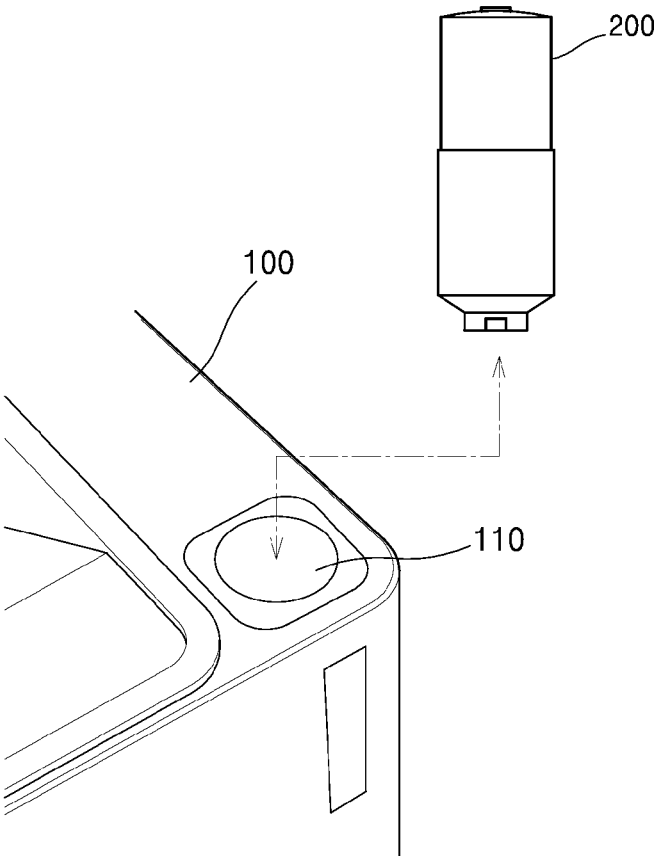
[Fig. 2]
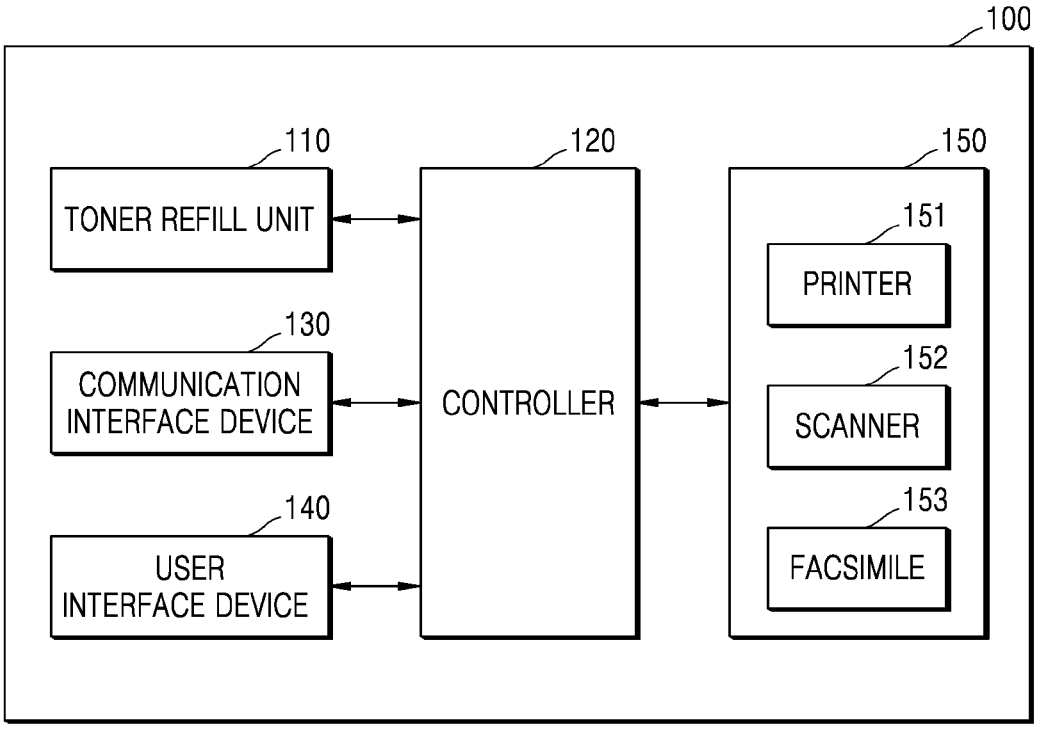

[Fig. 3]
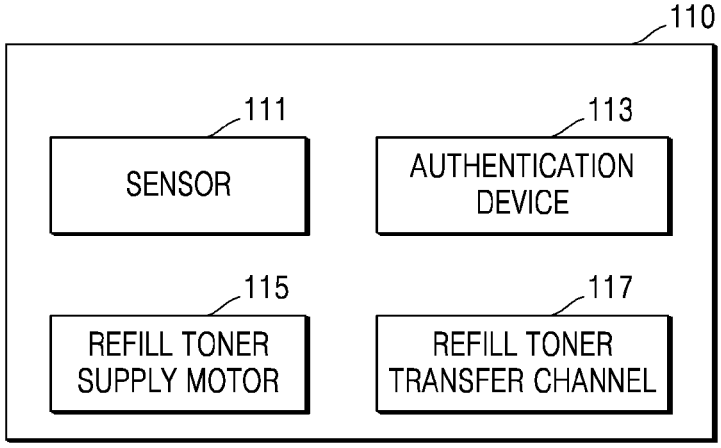
[Fig. 4]
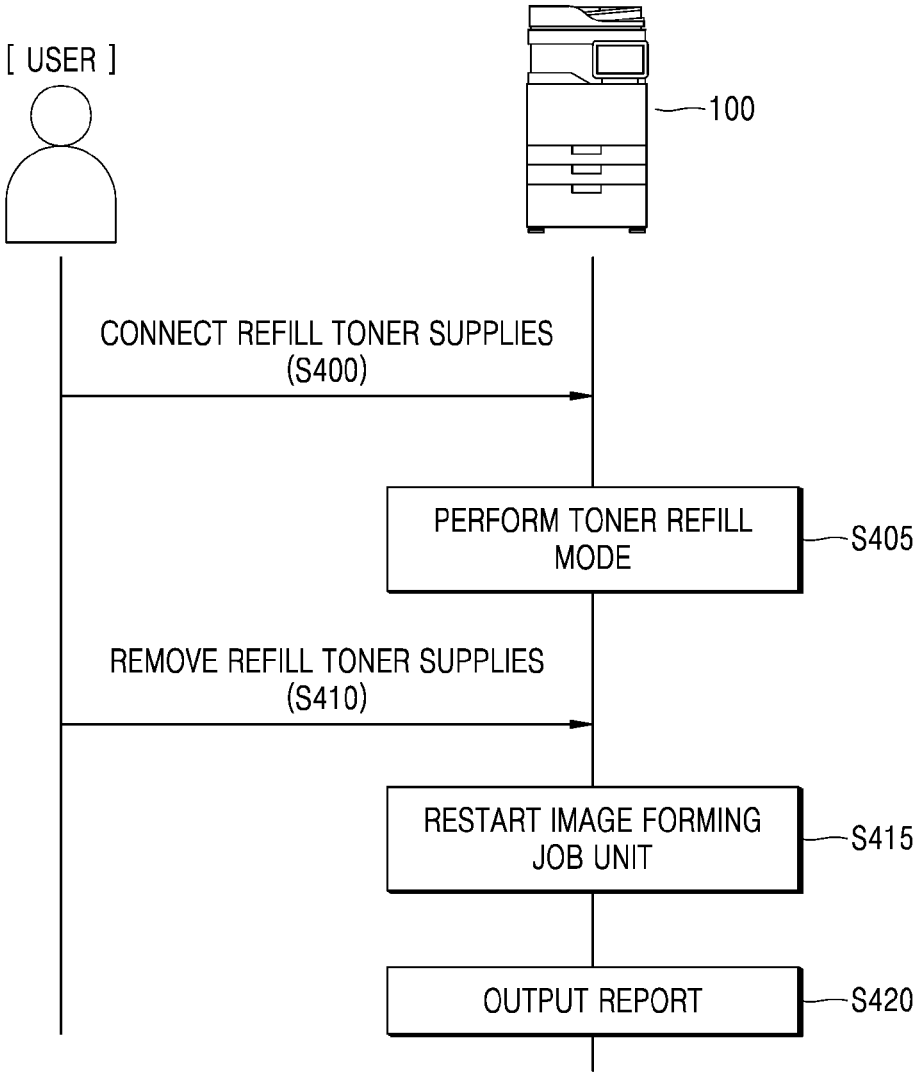

[Fig. 5]
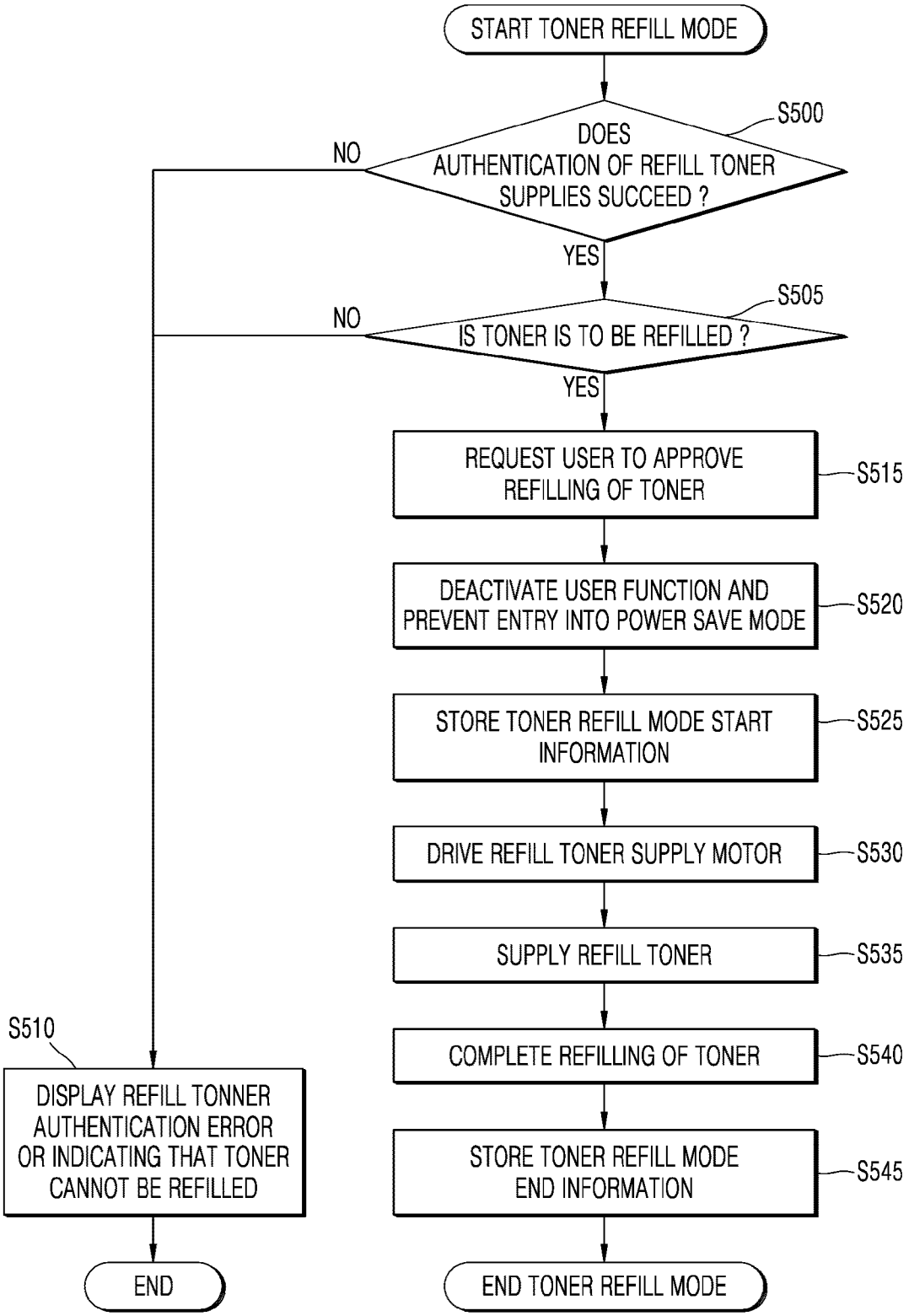

[Fig. 6]
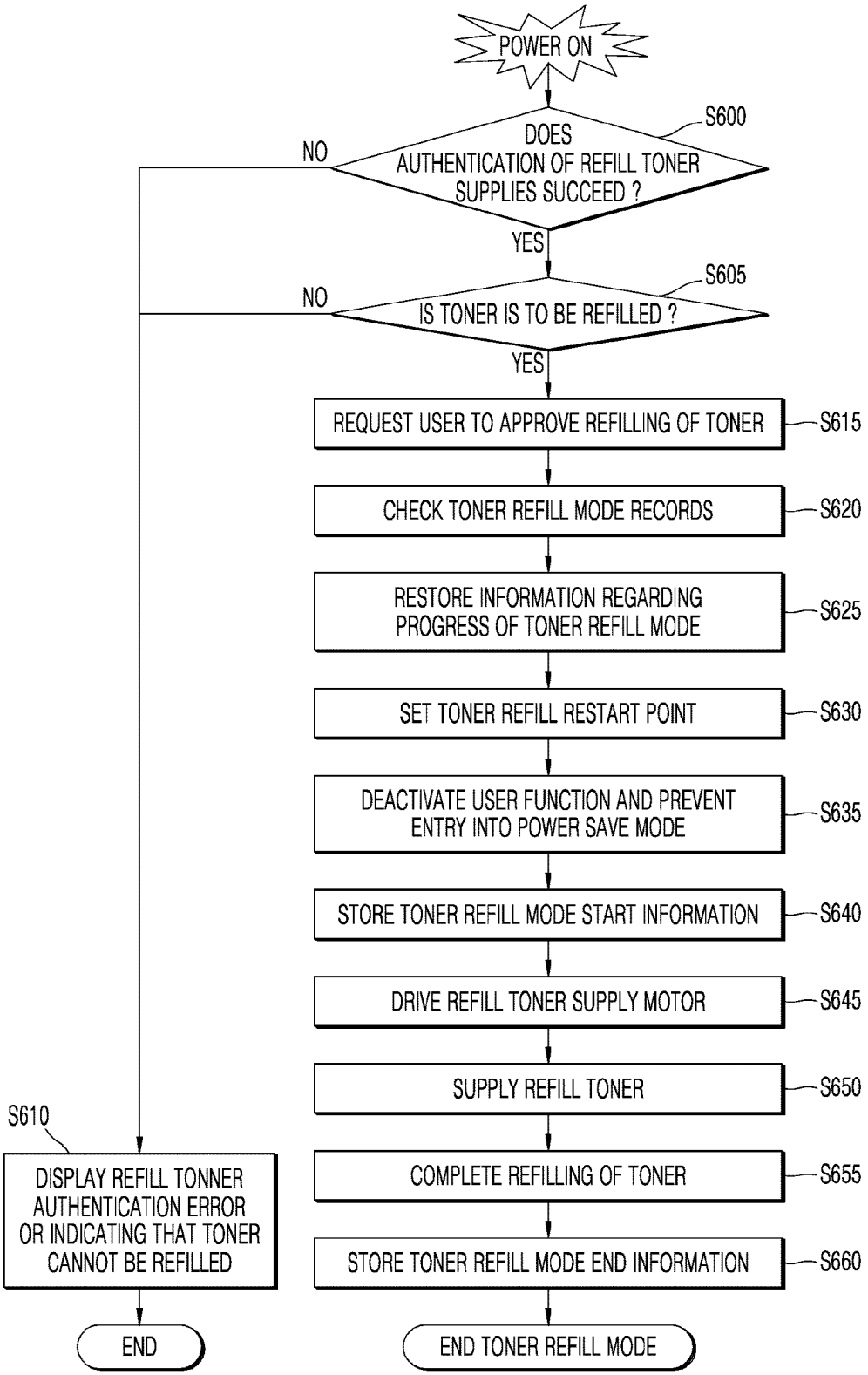

[Fig. 7]
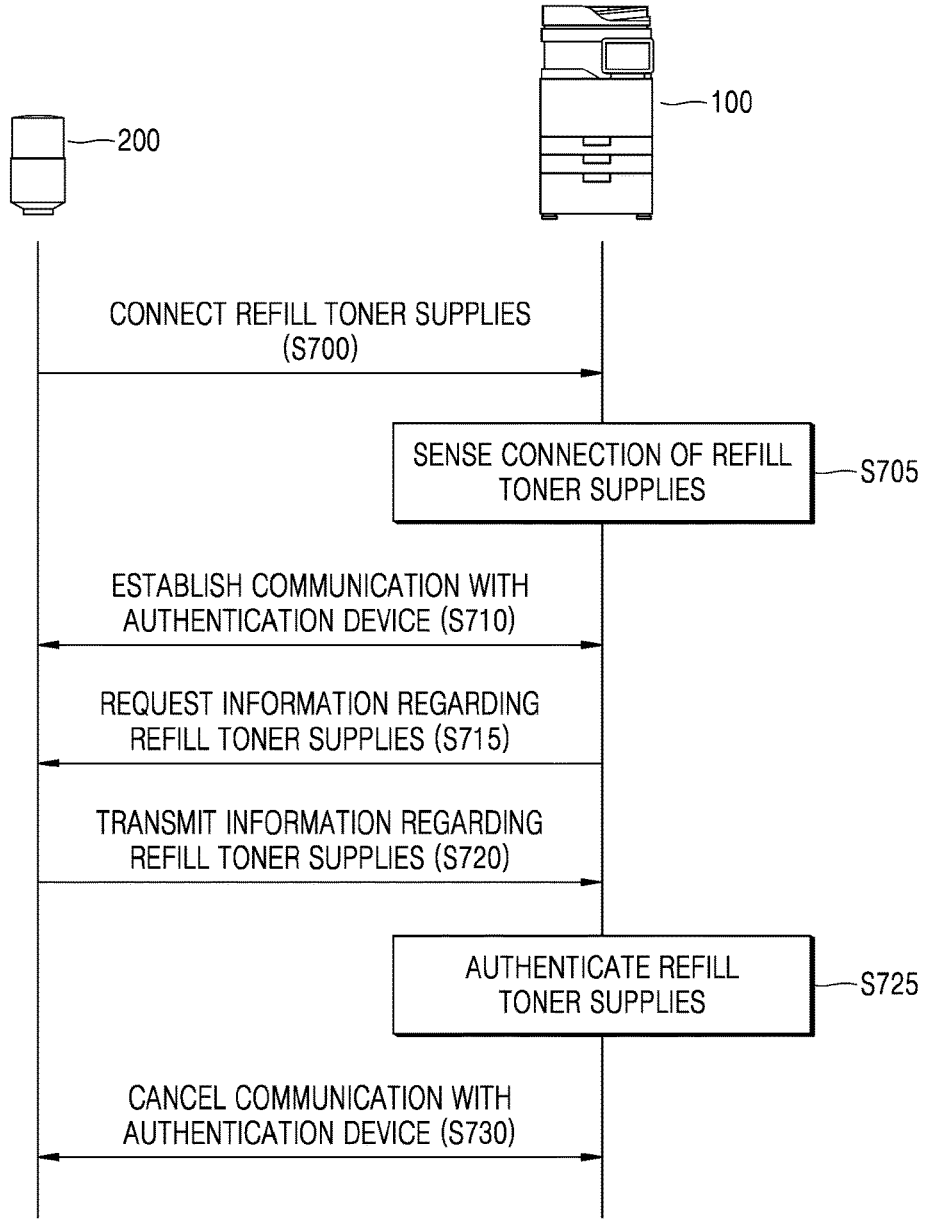
[Fig. 8]
| START TIME | MODEL | CAPACITY | SERIAL NUMBER | PROGRESS RATE | END TIME |
|---|---|---|---|---|---|
| 2018.3.9 19:40 | CTSS-K | 2.5K | CTSU148794321 | 50% | N/A |
⇩
| START TIME | MODEL | CAPACITY | SERIAL NUMBER | PROGRESS RATE | END TIME |
|---|---|---|---|---|---|
| 2018.3.9 19:40 | CTSS-K | 2.5K | CTSU148794321 | 100% | 2018.3.9 20:00 |

[Fig. 9]

Toner refill report

Date : 2018-03-09 : 21:30

Toner Refill Information

Toner refill unit ID : CTSU-346468654984
Toner refill unit Capability : 2.5K
Toner refill start time : 21:30:21
Toner refill end time : 21:55:00
Toner refill Progress : 100%

Toner Cartridge Information

Toner cartridge ID : TC-346468654984
Toner cartridge Capability : 5K
Toner cartridge remain before refill : 0.7K
Toner cartridge current : 3.2K

Toner refill history report

Date : 2018-03-09 : 21:30

| CTSU ID | Date | Status |
|---|---|---|
| CTSU-346468654984 | 2018-03-09 21:30:21 | Complete |
| CTSU-346468654984 | 2018-03-09 21:30:21 | Reboot |
| CTSU-346468456644 | 2018-01-09 11:30:21 | Complete |
| CTSU-341453454984 | 2017-12-09 15:30:21 | Complete |
| CTSU-346468656546 | 2018-11-09 17:30:21 | Complete |
| CTSU-346468618446 | 2018-10-09 06:30:21 | Complete |
| CTSU-342316489875 | 2018-09-09 02:30:21 | Complete |
| CTSU-346321987651 | 2018-07-09 15:30:21 | Complete |
| CTSU-336875168984 | 2018-06-09 21:30:21 | Complete |

SUPPLYING REFILL TONER TO MOUNTED TONER CARTRIDGE

CROSS REFERENCE TO RELATED APPLICATIONS

This application is a U.S. National Stage Application which claims the benefit under 35 U.S.C. § 371 of International Patent Application No. PCT/KR2018/008653 filed on Jul. 31, 2018, which claims priority from Korean Patent Application No. 10-2018-0049428 filed on Apr. 27, 2018, the contents of each of which are incorporated herein by reference in their entireties.

BACKGROUND ART

A toner cartridge may be replaced when printing is performed a large number of times by an image forming apparatus resulting in toner contained in the toner cartridge being exhausted. The toner cartridge may be separated and removed from the image forming apparatus and be replaced with a new toner cartridge.

DISCLOSURE

Description of Drawings

FIG. 1 is a diagram illustrating a toner refill unit of an image forming apparatus and refill toner supplies according to an example;

FIG. 2 is a block diagram of an image forming apparatus according to an example;

FIG. 3 is a detailed block diagram of a toner refill unit of an image forming apparatus according to an example;

FIG. 4 is a flowchart of a process of refilling toner by connecting refill toner supplies to an image forming apparatus, according to an example;

FIG. 5 is a diagram for explaining a toner refill mode according to an example;

FIG. 6 is a diagram for explaining a toner refill mode when an image forming apparatus is powered on while refill toner supplies are connected to a toner refill unit, according to an example;

FIG. 7 is a flowchart of a process of authenticating refill toner supplies, according to an example;

FIG. 8 is a diagram illustrating an example in which a toner refill progress status is displayed, according to an example; and FIG. 9 is a diagram illustrating an example in which a toner refill report is output, according to an example.

MODE FOR INVENTION

Hereinafter, various examples will be described with reference to the accompanying drawings below. In the present specification and drawings, components having substantially the same function will be assigned the same reference numeral and will not be redundantly described herein.

As used herein, expressions such as "at least one of," when preceding a list of elements, modify the entire list of elements and do not modify the individual elements of the list.

FIG. 1 is a diagram illustrating a toner refill unit 110 of an image forming apparatus 100 and refill toner supplies 200 according to an example.

The image forming apparatus 100 may perform an image forming job such as printing, scanning, or faxing. The image forming apparatus 100 may perform the image forming job according to a user input received via a user interface device. The image forming apparatus 100 may use toner to perform a print job. A toner cartridge may store toner to be used for the image forming job. The toner cartridge may be mounted in the image forming apparatus 100, and form a visual toner image on a photosensitive medium by supplying the toner to an electrostatic latent image formed on the photosensitive medium. When the toner of the toner cartridge is exhausted, the toner cartridge needs to be replaced with a new cartridge by a user. General users who are not accustomed to the structure or operation of the mage forming apparatus 100 may have difficulties separating and removing the toner cartridge from the image forming apparatus 100 and mounting a new toner cartridge in the image forming apparatus 100. A method of refilling toner in the toner cartridge mounted in the image forming apparatus 100 by using the refill toner supplies 200 without separating the toner cartridge from the image forming apparatus 100 will be described below.

FIG. 1 illustrates that the image forming apparatus 100 is connectable to the refill toner supplies 200. The refill toner supplies 200 may be consumables to be used to fill a toner cartridge with toner. The refill toner supplies 200 are to store toner therein. A structure of the refill toner supplies 200 may correspond to that of a connection part of a toner refill unit 110 included in the image forming apparatus 100 so that the refill toner supplies 200 may be coupled and connected to the image forming apparatus 100.

As illustrated in FIG. 1, the connection part of the toner refill unit 110 connected to the refill toner supplies 200 may be exposed to the outside of the image forming apparatus 100. The toner refill unit 110 may be provided in the image forming apparatus 100 such that the connection part thereof to be connected to the refill toner supplies 200 is accessible outside the image forming apparatus 100. The connection part of the toner refill unit 110 to which the refill toner supplies 200 is physically connected may be provided on a side surface of the exterior of the image forming apparatus 100 such that the refill toner supplies 200 may be directly coupled and connected to the image forming apparatus 100. The toner refill unit 110 may be connected to the refill toner supplies 200, and supply refill toner from the refill toner supplies 200 connected thereto to a toner cartridge mounted in an image forming job unit of the image forming apparatus 100. The toner refill unit 110 may supply the refill toner to the toner cartridge mounted in the image forming job unit.

FIG. 2 is a block diagram of an image forming apparatus 100 according to an example.

Referring to FIG. 2, the image forming apparatus 100 may include a toner refill unit 110, a controller 120, a communication interface device 130, a user interface device 140, and an image forming job unit 150. However, it will be apparent to those of ordinary skill in the art related to the current example that the image forming apparatus 100 may further include other general components, as well as the components illustrated in FIG. 2.

When the refill toner supplies 200 of FIG. 1 is connected to the toner refill unit 110, the toner refill unit 110 may be supplied with refill toner from the refill toner supplies 200 and may transfer the refill toner to a toner cartridge mounted in the image forming job unit 150.

The controller 120 may control overall operations of the image forming apparatus 100, and include at least one processor corresponding to each of the operations. Although not shown, the controller 120 may include a random access memory (RAM), a read-only memory (ROM), a central processing unit (CPU), a graphical processing unit (GPU), etc. The RAM, the ROM, the CPU, the GPU, etc. may be connected to one another via a data bus. The CPU may perform booting using an operating system (O/S) stored in a storage unit (not shown) by accessing the storage unit. Furthermore, the CPU may perform various operations using various programs, data, etc. stored in the storage unit. A set of instructions for booting the system, etc. may be stored in the ROM. For example, when a turn-on command is input to power on the image forming apparatus 100, the CPU may boot the system by copying the O/S stored in the storage unit to the RAM and executing the O/S according to the instructions stored in the ROM. After the booting of the system is completed, the CPU may perform various operations by coping the various programs stored in the storage unit to the RAM and executing the copied programs. After the booting of the image forming apparatus 100 is completed, the GPU may display a user interface screen on a region of the user interface device 140. The controller 120 may perform an operation corresponding to a user's manipulation input to the user interface device 140, according to the user's manipulation.

The image forming apparatus 100 may be connected to an external device via the communication interface device 130, The communication interface device 130 may include a module supporting at least one among various wired/wireless communication methods to connect to or communicate with an external device. The wireless communication may include, for example, at least one among Wireless Fidelity (Wi-Fi), Wi-Fi Direct, Bluetooth, Ultra-Wide Band (UWB) and Near-Field Communication (NFC). The wired communication may include, for example, at least one of Universal Serial Bus (USB) or High-Definition Multimedia Interface (HDMI).

The user interface device 140 may receive an input from a user and display information to the user. The user interface device 140 may include an input unit to receive an input for an image forming job or the like from the user. The user interface device 140 may further include an output unit to display information regarding the image forming job or a state of the image forming apparatus 100. For example, the user interface device 140 may be in the form of a touch screen including an operation panel to receive user input and a display panel to display an image.

Although the image forming job unit 150 is illustrated as including a printer 151, a scanner 152 and a facsimile 153, the image forming job unit 150 may include some of these components or may further include other components to perform a different image forming job, if necessary. The image forming job unit 150 may include hardware components to perform the image forming job, and include dedicated machine readable instructions to perform the image forming job. The printer 151 may form an image on a recording medium according to various printing methods such as an electrophotographic method, an inkjet method, a thermal transfer method, a thermosensitive method, etc. The scanner 152 may read an image recorded on a document by emitting light to the document and receiving light reflected from the document. The facsimile 153 may share components for scanning an image with the scanner 152, share components for printing a received file with the printer 151, and transmit a scanned file to a destination or receive a file from the outside.

FIG. 3 is a detailed block diagram of a toner refill unit 110 of an image forming apparatus 100 according to an example.

Referring to FIG. 3, the toner refill unit 110 may include a sensor 111, an authentication device 113, a refill toner supply motor 115, and a refill toner transfer channel 117. However, some of these components may be omitted or replaced with other components.

The sensor 111 may sense physical connection of the refill toner supplies 200 to the toner refill unit 110.

The authentication device 113 may receive information regarding the refill toner supplies 200 by communicating with the refill toner supplies 200 of which the physical connection to the toner refill unit 110 is sensed, and authenticate whether the refill toner supplies 200 are genuine products, based on the received information.

Refill toner may be discharged from the refill toner supplies 200 by using the refill toner supply motor 115. For example, the refill toner may be discharged from the refill toner supplies 200 by applying pressure to the refill toner supplies 200 by driving the refill toner supply motor 115. When the refill toner supply motor 115 is used in the toner refill unit 110, the refill toner supplies 200 may be manufactured to be connectable with the refill toner supply motor 115.

If the refill toner supplies 200 is manufactured to shrink when external pressure is applied thereto, the refill toner may be discharged from the refill toner supplies 200 when the refill toner supplies 200 is pressurized by a user. When the refill toner supplies 200 includes a motor to discharge the refill toner and a switch to operate the motor, the refill toner may be discharged from the refill toner supplies 200 by pressing the switch of the refill toner supplies 200. In these cases, the refill toner supply motor 115 of the toner refill unit 110 of FIG. 3 may be omitted.

The refill toner discharged from the refill toner supplies 200 may be transferred to a toner inlet at a side surface of a toner cartridge via the refill toner transfer channel 117.

FIG. 4 is a flowchart of a process of refilling toner by connecting the refill toner supplies 200 to the image forming apparatus 100, according to an example.

A user may connect the refill toner supplies 200 to the image forming apparatus 100 (operation S400).

The image forming apparatus 100 may perform a toner refill mode (operation S405), When the refill toner supplies 200 is connected to the toner refill unit 110, the user interface device 140 may display a toner refill progress. When the refill toner supplies 200 is connected to the toner refill unit 110, the controller 120 may receive approval for refilling toner from the user via the user interface device 140, and control the image forming apparatus 100 to operate according to the toner refill mode. In the toner refill mode, the controller 120 may deactivate a function to be provided to the user to prevent the image forming job unit 150 from being operated via a user's manipulation of the user interface device 140. The controller 120 may stop an operation of the image forming job unit 150. The controller 120 may prevent entry of the toner refill unit 110 into a power save mode, and control refill toner to be supplied.

After the refilling of the toner is completed, the user may remove the refill toner supplies 200 from the image forming apparatus 100 (operation S410). When the refill toner supplies 200 is removed from the toner refill unit 110, the controller 120 may set the toner refill unit 110 to a stopped state. The controller 120 may cancel the deactivation of the function to be provided to the user.

The image forming apparatus 100 may restart the image forming job unit 150 (operation S415). The controller 120 may control the image forming apparatus 100 to operate in a normal mode by restarting the image forming job unit 150 stopped due to the toner refill mode. In this case, the image forming job unit 150 may perform initialization.

The image forming apparatus 100 may output a report regarding the refilling of the toner (operation S420). The controller 120 may generate the report regarding the refilling of the toner, based on at least one among toner refill mode start information, toner refill progress status information, and toner refill mode end information stored in the image forming apparatus 100, and output the report via the user interface device 140. The toner refill mode will be described in detail with reference to FIG. 5 below.

FIG. 5 is a diagram for explaining a toner refill mode according to an example.

The image forming apparatus 100 may authenticate the refill toner supplies 200 when the refill toner supplies 200 are connected thereto to determine whether the authentication of the refill toner supplies 200 succeeds so as to determine whether the refill toner supplies 200 are genuine products (operation S500).

The image forming apparatus 100 may determine whether toner is to be refilled by checking whether refill toner may be supplied from the refill toner supplies 200 connected thereto (operation S505). For example, the image forming apparatus 100 may determine that toner cannot be refilled when the refill toner does not remain in or cannot be discharged from the refill toner supplies 200.

When the authentication of the refill toner supplies 200 cannot be performed or fails or when toner cannot be refilled, the image forming apparatus 100 may output via the user interface device 140 a message indicating a refill tonner authentication error or indicating that toner cannot be refilled (operation 3510).

When it is determined that the authentication of the refill toner supplies 200 succeeds and toner may be refilled, the image forming apparatus 100 may request a user to approve the refilling of the toner and receive an instruction to start the refilling of the toner from the user via the user interface device 140 (operation S515).

In order to prosecute the refilling of the toner, the image forming apparatus 100 may deactivate a function to be provided to the user to prevent the image forming job unit 150 from being operated via the user's manipulation of the user interface device 140, and prevent the entry of the toner refill unit 110 into the power save mode (operation S520). The image forming apparatus 100 may stop an operation of the image forming job unit 150 while the refilling of the toner is performed. The image forming apparatus 100 may be maintained in a state as if it enters the power save mode by stopping operations of a fuser, a laser scanning unit (LSU), a paper feed unit, etc.

As the refilling of the toner starts, the image forming apparatus 100 may store toner refill mode start information (operation S525). The toner refill mode start information may include an identification (ID) number, model name, and capacity of the refill toner supplies 200, and a date and time when the refilling of the toner is started.

The image forming apparatus 100 may drive the refill toner supply motor 115 to discharge the refill toner from the refill toner supplies 200 (operation 3530). However, a user may pressurize or operate the refill toner supplies 200 to discharge the refill toner from the refill toner supplies 200 when the refill toner supply motor 115 is not included in the toner refill unit 110, when the refill toner supplies 200 is to shrink when external pressure is applied thereto, or when the refill toner supplies 200 has a component to discharge the refill toner.

The image forming apparatus 100 may supply the refill toner from the refill toner supplies 200 to the toner cartridge mounted in the image forming job unit 150 (operation S535). The image forming apparatus 100 may store toner refill progress status information while the refilling of the toner is conducted. When the image forming apparatus 100 is powered off during the refiling of the toner or when a situation preventing the prosecution of the refilling of the toner occurs, toner refill progress status information may be stored in the image forming apparatus 100 so that the refilling of the toner may be continued at a later time.

The image forming apparatus 100 may complete the refilling of the toner when the refill toner is not discharged from the refill toner supplies 200 any longer or when the amount of toner filled in the toner cartridge reaches a certain level or more (operation S540).

When the refilling of the toner is completed, the image forming apparatus 100 may store toner refill mode end information (operation S545). The toner refill mode end information may include the ID number, model name, and capacity of the refill toner supplies 200, and a date and time when the refilling of the toner is completed.

If the refill toner supplies 200 is connected to the toner refill unit 110 during performing of an image forming job by the image forming apparatus 100, the image forming apparatus 100 may perform the toner refill mode according to a user's selection to cancel, temporary stop, or complete the image forming job, which is currently being performed, via the user interface device 140 or may cancel the refilling of the toner.

If the refill toner supplies 200 is connected to the toner refill unit 110 when the image forming apparatus 100 is in the power save mode, the controller 120 may receive information indicating the connection of the refill toner supplies 200 from the sensor 111 capable of sensing the physical connection of the refill toner supplies 200 even in the power save mode, and may switch the power save mode to the toner refill mode.

FIG. 6 is a diagram for explaining the toner refill mode when the image forming apparatus 100 is powered on while the refill toner supplies 200 are connected to the toner refill unit 110, according to an example.

Operations 3600 to S615 and S635 to S660 of FIG. 6 are substantially the same as operations S500 to S545 described above with reference to FIG. 5 and thus are not redundantly described here. Operations S620, S625, and S630 performed before refilling of toner is started according to a user's approval for the refilling of the toner will be described with reference to FIG. 6 below.

In order to power on the image forming apparatus 100 to boot or reboot the image forming apparatus 100 while the refill toner supplies 200 is connected to the image forming apparatus 100, whether the toner refill mode is in progress needs to be checked before the image forming apparatus 100 is powered on. The refilling of the toner may be performed according to the toner refill mode described above with reference to FIG. 5 when the toner refill mode is not in progress, but the image forming apparatus 100 may be controlled to proceed with an operation subsequent to the toner refill mode when the toner refill mode is in progress.

The image forming apparatus 100 may determine whether the toner refill mode is in progress, based on information regarding the refill toner supplies 200 received from the toner refill unit 110 and toner refill mode records and information stored in the memory (operation S620).

When rebooting occurs during the toner refill mode, the image forming apparatus 100 may restore information regarding a progress status of the toner refill mode (operation S625).

The image forming apparatus 100 may set a toner refill restart point (operation S630).

FIG. 7 is a flowchart of a process of authenticating the refill toner supplies 200, according to an example.

The process of authenticating the refill toner supplies 200 may be performed in operation S500 of FIG. 5 and operation S600 of FIG. 6 described above.

Referring to FIG. 7, a user may connect the refill toner supplies 200 to the image forming apparatus 100 (operation S700).

The image forming apparatus 100 may sense the refill toner supplies 200 physically connected to the image forming apparatus 100 through the sensor 111 (operation S705).

Communication may be established between the authentication device 113 of the image forming apparatus 100 and the refill toner supplies 200 (operation S710). In this case, secure communication may be established between the authentication device 113 and the refill toner supplies 200.

The authentication device 113 of the image forming apparatus 100 may request the refill toner supplies 200 to provide information thereof (operation S715). The information regarding the refill toner supplies 200 may include the ID number, e.g., a serial number, model name, capacity, etc. of the refill toner supplies 200.

The refill toner supplies 200 may transmit the information regarding the refill toner supplies 200 to the authentication device 113 of the image forming apparatus 100, in response to the request to provide the information regarding the refill toner supplies 200 from the authentication device 113 (operation S720).

The authentication device 113 of the image forming apparatus 100 may perform the process of authenticating the refill toner supplies 200, based on the received information regarding the refill toner supplies 200 (operation S725).

When the process of authenticating the refill toner supplies 200 is completed, the communication between the authentication device 113 of the image forming apparatus 100 and the refill toner supplies 200 may be canceled (operation S730).

FIG. 8 is a diagram illustrating an example in which a toner refill progress status is displayed, according to an example.

The image forming apparatus 100 may display a progress rate indicating the toner refill progress status via the user interface device 140. The toner refill progress status may be periodically recorded and displayed at predetermined time intervals until the refilling of the toner is completed, and may be displayed via the user interface device 140 even when rebooting occurs during the toner refill mode.

The controller 120 of the image forming apparatus 100 may calculate the progress rate of the toner refill mode, based on at least one among information regarding the amount of injected toner measured by the refill toner supplies 200, an actuation time of the refill toner supply motor 115 of the toner refill supplies 200, and an increase in the amount of injected toner measured by a residual quantity sensor of a toner cartridge, the information being obtained by the authentication device 113 of the toner refill unit 110. For example, when the amount of injected toner may be measured by the refill toner supplies 200, the controller 120 may receive the information regarding the measured amount of injected toner by using the authentication device 113 connected to the refill toner supplies 200, and calculate the progress rate by dividing the amount of injected toner by the capacity of the refill toner supplies 200. As another example, when refill toner is supplied using the refill toner supply motor 115, the controller 120 may calculate the progress rate by dividing the actuation time of the refill toner supply motor 115 by an estimated total actuation time. As another example, the controller 120 may calculate the progress rate from the increase in the amount of injected toner starting from a toner refill start point by using the residual quantity sensor of the toner cartridge.

The image forming apparatus 100 may output the toner refill progress status as illustrated in FIG. 8 via the user interface device 140. Start time when the refilling of the toner is started, the model name, capacity, and serial number of the refill toner supplies 200, and the progress rate may be output via the user interface device 140, and end time may be further output when the refilling of the toner is completed, when the refilling of the toner is completed.

FIG. 9 is a diagram illustrating an example in which a toner refill report is output, according to an example.

The mage forming apparatus 100 may generate a toner refill report, based on at least one among toner refill mode start information, toner refill progress status information, and toner refill mode end information stored in the toner refill mode, and output the toner refill report via the user interface device 140, As illustrated in FIG. 9, the toner refill report including information regarding the refill toner supplies 200, information regarding a toner cartridge, and data generated as the toner refill mode is prosecuted, and a toner refill history report including details of all statuses of toner refilling performed by the image forming apparatus 100 may be output via the user interface device 140.

A method of controlling an image forming apparatus as described above may be embodied in the form of a computer-readable storage medium having stored therein instructions or data executable by a computer or a processor. In an example, the method may be embodied as a program which can be executed in a computer, and executed by a general-purpose digital computer capable of executing the program by using a computer-readable recording medium. Examples of the computer-readable recording medium may include ROMs, RAMs, flash memories, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard discs, solid-state discs (SSDs), and any other devices capable of storing instructions, software, machine readable instructions, related data, data files, and data structures and providing the instructions, the software, the machine readable instructions, the related data, the data files, and the data structures to processors or computers so that the instructions may be executed by the processors or the computers.

While examples have been described with reference to the drawings, it will be understood by those of ordinary skill in the art that various changes in form and details may be made therein without departing from the spirit and scope as defined by the following claims.

The invention claimed is:

1. An image forming apparatus comprising:

an image forming job unit having a toner cartridge mounted in the image forming job unit;

a toner refill unit connectable to refill toner supplies, to supply refill toner to the mounted toner cartridge from the refill toner supplies; and a controller to control the image forming apparatus to operate according to a toner refill mode based on an operation of the toner refill unit to control, a function of the image forming apparatus to prevent entry of the toner refill unit into a power save mode, and an operation of the toner refill unit to start the supply of the refill toner.

2. The image forming apparatus of claim 1, wherein the toner refill unit includes a connection part, the connection part is provided on a side surface of an exterior of the image forming apparatus, the refill toner supplies are connectable directly to the toner refill unit, and the toner refill unit is to supply the refill toner while the toner cartridge is mounted in the image forming job unit.

3. The image forming apparatus of claim 1, wherein the toner refill unit comprises a refill toner transfer channel to move the refill toner discharged from the refill toner supplies to a toner inlet provided at a side surface of the toner cartridge.

4. The image forming apparatus of claim 3, wherein the toner refill unit further comprises:

a sensor to sense a connection of the refill toner supplies to the toner refill unit; and an authentication device communicating with the refill toner supplies of which the physical connection to the toner refill unit is sensed, and authenticate whether the refill toner supplies are genuine products, based on the communication.

5. The image forming apparatus of claim 1, further comprising a user interface device to display a toner refill progress status when the refill toner supplies are connected to the toner refill unit, and wherein, when the refill toner supplies are connected to the toner refill unit, the controller receives approval to refill toner from a user via the user interface device and control the image forming apparatus to operate according to the toner refill mode.

6. The image forming apparatus of claim 5, wherein the controlling the function by the controller further includes at least one type of function from among functions to, deactivate a function to be provided to a user to prevent the image forming job unit from being operated via the user's manipulation of the user interface device, and stop an operation of the image forming job unit.

7. The image forming apparatus of claim 6, wherein the controller is to, when the refill toner supplies are removed from the toner refill unit, control the image forming apparatus to be operated in a normal mode by setting the toner refill unit to a stopped state, canceling the deactivating of the function to be provided to the user, and restarting the stopped image forming job unit.

8. The image forming apparatus of claim 5, wherein the controller is to receive the approval and control the image forming apparatus according to the toner refill mode to store toner refill mode start information by receiving information obtained by the toner refill unit when the refilling of the toner starts, store toner refill progress status information while the refilling of the toner is conducted, and store toner refill mode end information when the refilling of the toner is completed.

9. The image forming apparatus of claim 8, wherein the controller is to generate a toner refill report, based on at least one type of information from among the toner refill mode start information, the toner refill progress status information, and the toner refill mode end information, and output the toner refill report via the user interface device.

10. The image forming apparatus of claim 1, wherein, when the refill toner supplies are connected to the toner refill unit while the image forming apparatus is in a power save mode, the controller is to receive information indicating the connection of the refill toner supplies from a sensor capable of sensing a physical connection of the refill toner supplies in the power save mode, and switch the power save mode to the toner refill mode.

11. The image forming apparatus of claim 5, wherein, when the image forming apparatus is powered on while the refill toner supplies are connected to the toner refill unit, the controller is to check whether the toner refill mode is in progress, based on information regarding the refill toner supplies received from the toner refill unit and toner refill mode records, and information stored in a memory, and set a toner refill restart point by restoring information regarding a progress status of the toner refill mode.

12. The image forming apparatus of claim 5, wherein an authentication device of the toner refill unit is to obtain at least one type of information from among information indicating an amount of injected toner measured by the refill toner supplies, an actuation time of a refill toner supply motor of the toner refill unit, and an increase in the amount of injected toner sensed by a residual quantity sensor of the toner cartridge, wherein the controller is to calculate a progress rate of the toner refill mode, based on at least one type of information from among the information indicating the amount of injected toner measured by the refill toner supplies, the actuation time of a refill toner supply motor of the toner refill unit, and the increase in the amount of injected toner sensed by a residual quantity sensor of the toner cartridge, and display the calculated progress rate via the user interface device.

13. The image forming apparatus of claim 5, wherein, when the refill toner supplies are connected to the toner refill unit while an image forming job is in progress, the controller is to conduct the toner refill mode according to the user's selection via the user interface device to instruct to cancel, temporarily stop, or complete the image forming job which is in progress, or cancel the supply of the refill toner.

14. A method of controlling an image forming apparatus, the method comprising:

connecting refill toner supplies and the image forming apparatus;

supplying, from the connected refill toner supplies, refill toner to a toner cartridge mounted in an image forming job unit; and controlling the image forming apparatus to operate according to a toner refill mode based on an operation of the toner refill unit to control, a function of the image forming apparatus to prevent entry of the toner refill unit into a power save mode, and an operation of the toner refill unit to start the supply of the refill toner.

* * * * *